United States Patent [19]

Finnemore

[11] 4,159,033

[45] Jun. 26, 1979

[54] TRUNNION SEAL

[75] Inventor: Harlan E. Finnemore, Wellsville, N.Y.

[73] Assignee: The Air Preheater Company, Inc., Wellsville, N.Y.

[21] Appl. No.: 875,368

[22] Filed: Feb. 6, 1978

[51] Int. Cl.[2] ..... F28D 19/00

[52] U.S. Cl. ..... 165/7; 165/9; 277/22

[58] Field of Search ..... 165/7, 9, 8; 277/22

[56] References Cited

U.S. PATENT DOCUMENTS

| | | | |
|---|---|---|---|
| 2,673,718 | 3/1954 | Ljungstrom | 165/7 |
| 3,151,667 | 10/1964 | Hazzard | 165/7 |
| 3,822,739 | 7/1974 | Kurschner | 165/9 |
| 3,980,128 | 9/1976 | Stockman | 165/9 |

FOREIGN PATENT DOCUMENTS

| | | | |
|---|---|---|---|
| 147208 | 7/1952 | Australia | 165/7 |

*Primary Examiner*—Albert W. Davis, Jr.
*Attorney, Agent, or Firm*—Wayne H. Lang

[57] ABSTRACT

A sealing means that lies intermediate a rotatable trunnion and fixed housing structure of a rotary regenerative heat exchanger device to preclude the flow of leakage fluid therebetween. A cooling jacket is positioned concentrically around the sealing means to simultaneously cool the sealing means and any hot fluid leaking thereto.

8 Claims, 2 Drawing Figures

TRUNNION SEAL

BACKGROUND OF THE INVENTION

A rotary regenerative heat exchanger of the type defined herein comprises a cylindrical trunnion that supports an axially aligned rotor carrying a mass of heat absorbent material. The rotor is rotated about its axis in order that the heat exchange material therein may alternately be moved between hot and cold fluids flowing therethrough. Consequently, heat absorbed from the hot fluid is transferred to the cold fluid through the intermediary of the heat absorbent material carried by the rotor.

Inasmuch as the several fluids flowing through the heat absorbent material of the rotor are maintained at various pressure levels, there is a great tendency toward leakage between the compartments containing the high pressure fluid and the low pressure fluid. Even when provided with suitable sealing means between relatively movable parts of the rotor, some leakage of fluid will occur, and when the temperature of the leakage may range from 1250° F. to 1500° F., extensive damage may be effected by the hot fluid after it has leaked from its normal containment chamber.

For these reasons effective sealing means must be incorporated into the heat exchanger, and to be particularly effective for the sealing of high temperature fluids, some arrangement must be included in the sealing arrangement for effectively cooling the leakage fluid to a temperature that will not adversely affect surrounding materials, when such leakage does occur.

Sealing means that attempts to preclude the leakage of gas from a rotary regenerative preheater was disclosed by U.S. Pat. No. 3,822,738 of July 9, 1974, issued to Hermann E. Kurschner, and by U.S. Pat. No. 3,980,128 of Sept. 14, 1976, issued to Richard F. Stockman. In both of these patents some provision was made for a seal permitting simultaneous radial and axial movement of the relatively movable sealing elements, however no arrangement was disclosed for cooling or otherwise neutralizing the leakage fluid that was bound to occur.

SUMMARY OF THE INVENTION

This invention is therefore directed toward a sealing means that precludes fluid flow between relatively movable parts of a rotary regenerative heat exchanger while it permits relative axial, radial and circumferential movement therebetween. Furthermore, this invention provides for a cooling arrangement that reduces the temperature of the sealing means while it simultaneously reduces the temperature of the fluid leaking thereto.

BRIEF DESCRIPTION OF THE DRAWING

The invention will be more fully described with reference to the accompanying drawing in which.

DESCRIPTION OF THE PREFERRED EMBODIMENT

Figure 1:
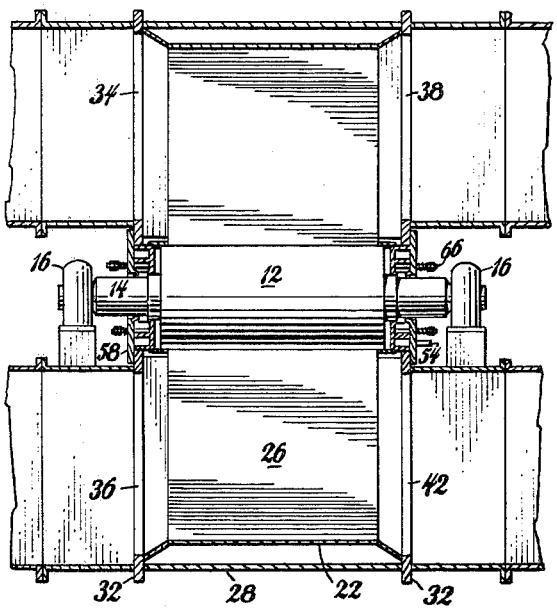
FIG. 1 is a sectional elevation of an air preheater having a sealing means constructed in accordance with this invention.
Figure 2:
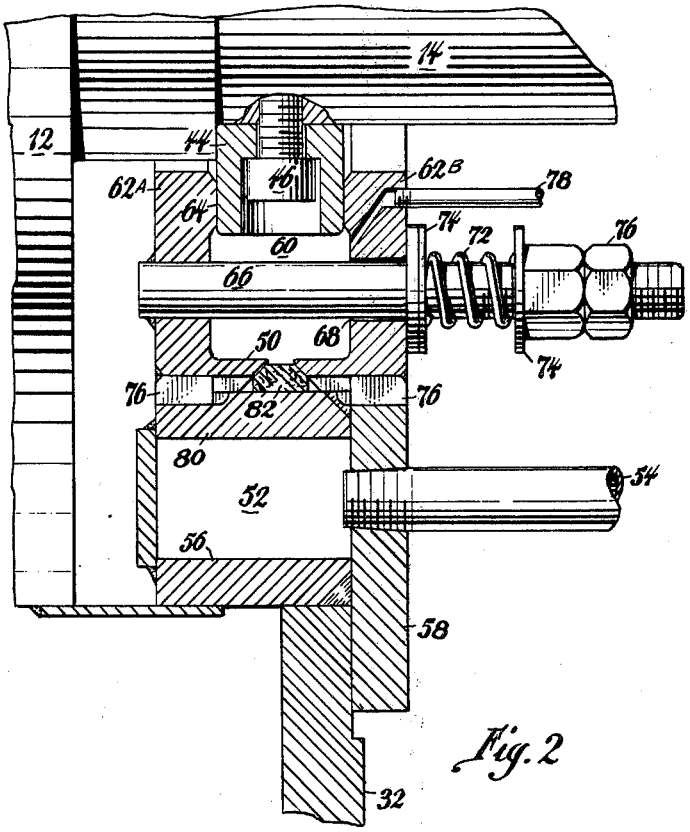
FIG. 2 is an enlarged detail of a preferred embodiment of my invention showing the sealing arrangement intermediate the rotor trunnion and the surrounding housing structure.

The arrangement of the drawing is directed to a rotary regenerative heat exchanger having a rotor post 12 with trunnions 14 at opposite ends thereof that are rotatably supported by bearings 16. A rotor shell 22 is connected to the rotor post by diaphragms to form compartments for a mass of heat absorbent material 26. The rotor is contained in a housing structure 28 having end plates 30–32 with openings 34–36–38–42 at opposite ends thereof whereby a heating fluid and a fluid to be heated may simultaneously flow oppositely through the heat absorbent material of the rotor. The rotor is rotated about its axis by a drive motor and reducing gear arrangement not here shown.

To preclude fluid from leaking into or out of the rotor housing and between the trunnions and end plates 30–32, special trunnion seals are provided. Inasmuch as the temperature of the leakage fluid is substantially the same temperature as that which is being directed through the heat exchanger, it is quite common for the temperature of the heating fluid to range from 1200° F. to 1500° F.

Inasmuch as such high temperatures may harm the structural integrity of the device, this invention includes cooling means that is combined with the sealing means that reduces the temperature of the sealing means while it simultaneously cools the high temperature leakage fluid before it comes in contact with the sealing means. These and other features of my invention are shown as means that cooperate with a sealing flange 44 which is fixed concentrically to the trunnions 14 by capscrews 46 whereby said flange 44 may rotate with trunnions 14 while it is free to be moved axially in accordance with thermal variation of the rotor.

A cooling chamber 52 having a source of cooling fluid 54 is comprised of a housing 56 having a flange 58 that is secured to one of end plates 32 directly outboard from the sealing flange 44 to provide a space therebetween occupied by the floating sealing member comprised of independent sealing rings 62A and 62B. The sealing rings are adapted to slidingly abut the sealing flange 44 along a surface 64 that is normal to the rotational axis of the rotor, while the housing 56 is fixed to the rings 62 by keys 63 that permit axial movement between the cooling housing 56 and the sealing rings 62.

The complementary sealing rings 62A and 62B include rubbing surfaces 64 that rub against the lateral sides of the sealing ring 44 and together with cooperating end walls 50 form a sealing chamber 60 therein. Biasing means including a tension rod 66 is secured to sealing ring 62A and is adapted to extend axially through an aligned opening 68 of ring 62B whereby a compressive force applied to a spring 72 that surrounds tension rod 66 intermediate washers 74 will bias the complementary rings 62A and 62B oppositely against ring 44 with sufficient force to preclude fluid flow through the clearance space therebetween. The washers 74 may be formed of asbestos or equivalent heat resisting material to surround rod 66 and fully enclose the space within the sealing rings to prevent fluid leakage therefrom. An adjusting nut 76 is threaded to the end of tension rod 66 to permit the spring 72 to be compressed gradually thereby placing a predetermined compressive force upon said spring 72 that is instrumental in forcing the annular sealing members 62A and 62B against the sides of sealing ring 44 to permit minimum leakage therebetween.

The sealing chamber 60 is provided with an inlet duct 78 whereby fluid under pressure may be supplied from a source (not shown) to maintain the space in said chamber at a pressure that exceeds that of said leakage fluid. Accordingly, there may be some leakage of pressure fluid out of chamber 60 between the surface 64 and ring 44, but there can be no leakage of hot fluid at low pressure out of the rotor in the opposite direction.

A high temperature resistant packing means or gasket 82 intermediate rings 62A and 62B precludes leakage of pressure fluid from chamber 60 to the atmosphere via a leakage path intermediate the wall 80 enclosing chamber 52 and the walls 50.

I claim:

1. A regenerative heat exchange apparatus including a rotor having a central rotor post, trunnion means integral with the rotor post extending axially therefrom, a concentric shell spaced from the rotor post to provide an annular space for a mass of heat absorbent material, a mass of perforate heat absorbent element packed in said annular space, housing means surrounding the rotor including end plates at opposite ends thereof having inlet and outlet openings that direct a heating fluid and a fluid to be heated through the heat absorbent element of the rotor, bearing means adapted to support the trunnion means for rotation about its axis, trunnion sealing means intermediate the trunnions and the surrounding housing structure adapted to restrict leakage of hot fluid from the rotor while it simultaneously cools said leakage fluid to a temperature that is compatible with the materials of said sealing means, said sealing means comprising an annular flange affixed concentrically to said trunnion, sealing rings adapted to abut opposite sides of said flange to provide an annular sealing chamber radially outboard from said flange, and a cooling jacket outboard from said chamber adapted to cool said chamber and simultaneously reduce the temperature of the fluid leaking thereto.

2. A regenerative heat exchange apparatus as defined in claim 1 including spring means arranged to bias the independent sealing rings continuously into contact with opposite sides of said annular flange.

3. A regenerative heat exchange apparatus as defined in claim 2 including a source of pressurized air, and duct means directing pressurized air from said source to the sealing chamber that lies outboard from said annular flange.

4. A regenerative heat exchange apparatus as defined in claim 3 wherein said cooling means comprises an independent housing forming a cooling chamber that surrounds the sealing chamber, a source of cooling fluid, and means supplying said cooling fluid to the cooling chamber.

5. A regenerative heat exchange apparatus as defined in claim 4 wherein the sealing rings that comprise the annular sealing chamber slidably abut the surrounding cooling chamber to permit axial movement therebetween.

6. A regenerative heat exchange apparatus as defined in claim 5 wherein the independent housing forming the cooling chamber is affixed to said housing means that surrounds the rotor while the sealing rings are carried by the rotatable flange that surrounds the trunnion.

7. A regenerative heat exchange apparatus as defined in claim 6 wherein the independent housing that forms the cooling chamber lies intermediate the rotor and the trunnion sealing means.

8. A regenerative heat exchange apparatus as defined in claim 7 wherein the independent housing that forms the cooling chamber includes extended surface means to increase the transfer of heat from the hot fluid flowing over said surface to the cooling fluid inside said cooling chamber.

* * * * *